United States Patent [19]

Werner

[11] 4,080,034

[45] Mar. 21, 1978

[54] INSULATION PIERCING TAP ASSEMBLY

[75] Inventor: Walter Myers Werner, Downingtown, Pa.

[73] Assignee: AMP Incorporated, Harrisburg, Pa.

[21] Appl. No.: 778,410

[22] Filed: Mar. 17, 1977

Related U.S. Application Data

[63] Continuation-in-part of Ser. No. 694,495, Jun. 10, 1976, abandoned.

[51] Int. Cl.[2] ..... H01R 7/04
[52] U.S. Cl. ..... 339/98
[58] Field of Search ..... 339/97–99

[56] References Cited

U.S. PATENT DOCUMENTS

| | | | |
|---|---|---|---|
| 2,396,119 | 3/1946 | O'Neil | 339/97 R |
| 2,745,065 | 5/1956 | Maher | 339/99 R |
| 3,380,014 | 4/1968 | Schenker et al. | 339/97 R |
| 3,585,571 | 6/1971 | Davis | 339/97 P |
| 3,848,957 | 11/1974 | Kraft | 339/98 |

*Primary Examiner*—Joseph H. McGlynn
*Attorney, Agent, or Firm*—Allan B. Osborne; William J. Keating; Jay L. Seitchik

[57] ABSTRACT

The present invention relates to an assembly for electrically connecting two cables together. More particularly, the invention provides an upper and lower housing with a conductive commoning contact slidably positioned in the lower housing and adapted to pierce through the insulation of the two cables and make electrical contact with the conductive strands within.

2 Claims, 5 Drawing Figures

INSULATION PIERCING TAP ASSEMBLY

RELATED APPLICATIONS

This is a continuation-in-part of U.s. application Ser. No. 694,495, filed June 10, 1976 and now abandoned.

BACKGROUND OF THE INVENTION

1. Field of the Invention

This invention is in the field of electrically connecting a tap line cable to a through cable such as connecting a home to the main power distribution line.

2. Prior Art

An early connector is disclosed in U.S. Pat. No. 1,642,492. The connector has two similar complementary members having hooked upper ends adapted to hook over the main horizontal conductor and depending body portions arranged to firmly grip and support the branch or tap line.

A later U.S. Pat. No. 2,033,199 disclosed an insulated connector to connect a tap line to a main conductor. This connector consists of three insulating blocks, two end blocks and one intermediate block. The intermediate block has a contact member embedded in it so that the grooved ends thereof are exposed on either side of the block. Exposed sections of the cables are biased in their respective grooved ends of the contact member by the end blocks. Bolts secure the three blocks together. The insulation must be removed beforehand.

In U.S. Pat. No. 2,951,892 a multiple type of tap connector is disclosed. The main line is secured to plate like body by a bolted down cap plate. The tap lines are connected to the plate by passing through a bell-shaped socket and having a malleable sleeve crimped onto the end extending out of the socket.

In U.S. Pat. No. 3,065,449 a connector is disclosed that consists of a C-shaped member and a wedge that is forced into channel C-shaped member with the main line trapped in a chanel between the wedge and one end of the C-shaped member and the tap line trapped in a channel at the other end.

Like devices are disclosed in U.S. Pat. Nos. 3,257,499; 3,349,167 and 3,462,543.

In the aforementioned patents which are generally concerned with connecting a smaller or tap line to a large or main power distribution line, the cables must be stripped of insulation and further, the power must be interrupted or the installer must be protected and must use special devices adapted to permit them to work at a distance remote from the work site; e.g., a grip-all clampstick.

Accordingly it is an object of the present invention to provide an assembly which electrically connects two cables together in an insulation body without the need to strip the cable insulation or to interrupt the current flowing through one of the cables.

SUMMARY OF THE PRESENT INVENTION

An insulation piercing tap assembly is disclosed comprising two separate, insulative housings which provide a through passage near one end and an opening near the other end and a conductive commoning contact having insulation piercing teeth on both ends slidably positioned between and in contact with both the passage and openings. With a power distribution cable positioned in the passage and a tap line inserted in the opening, the teeth on the contact are driven through the cable insulation and into the cable conductors simply by fastening the two housings together.

BRIEF DESCRIPTION OF THE DRAWINGS

FIG. 5 is a perspective view of another embodiment of the commoning contact member of the present invention.

DESCRIPTION OF THE PREFERRED EMBODIMENT

Figure 1:
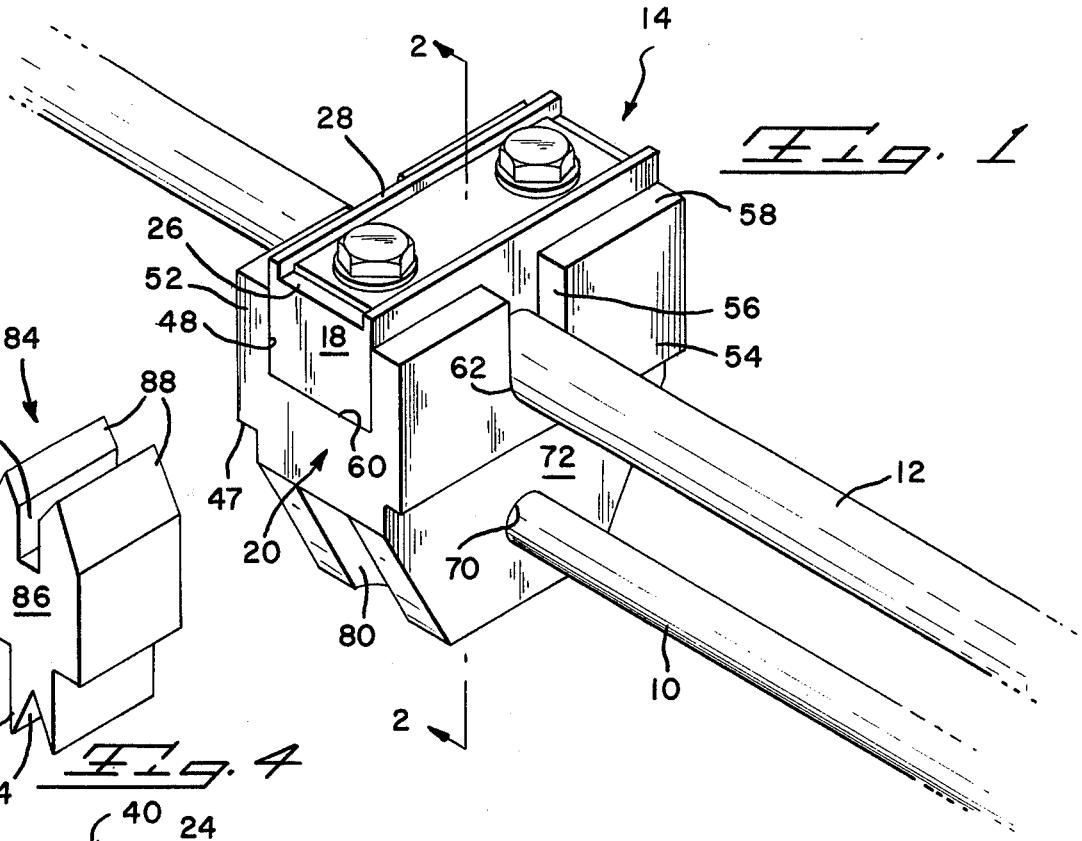
FIG. 1 is a perspective view of the preferred embodiment constructed in accordance with the present invention.

In FIG. 1 cable 10 is connected or tapped into a through-cable 12 by means of the insulation piercing tap assembly 14 constructed in accordance with the preferred embodiment of the present invention. In using tap assembly 14 it is not necessary or desirable to strip insulation 16 (FIGS. 2–3) from either cable.

In describing tap assembly 14, references are to all four figures. The assembly includes upper and lower housings 18 and 20 respectively. The upper housing 18 consists of a rectangular insulating block 22 and a bearing plate 24 positioned in a slight recess 26 on the top surface 28 of the block.

The bottom surface 30 of the block has an arcuate groove 32 extending across its width (normal to the long axis of the block). An elongated deflector pin 34 of 6061-T-6 aluminum or beryllium copper whose one surface is pointed to provide a tip 36 is embedded in the block so that tip 36 is pointing downwardly from the center of the arcuate groove. The pin has a length equal to about one-half the width of the block.

Two apertures 38 extend through the block, top to bottom, adjacent either side. Like apertures are also in the bearing plate. A pair of bolts 40 with threaded ends 42 are positioned through these apertures.

Lower housing 20 has a rectangular upper half 44 and in profile, a truncated triangular lower half 46. The lower half is not as wide as the upper half as indicated by the downwardly facing shoulders 47.

Figure 3:
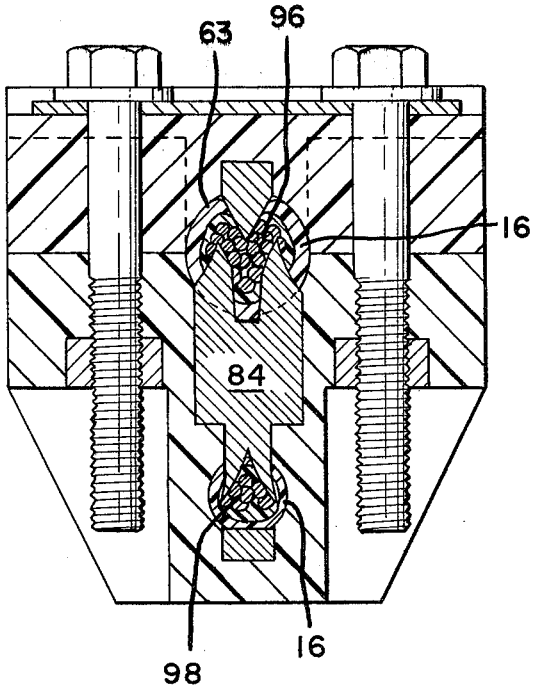
FIG. 3 is the view taken along the same lines as FIG. 2 but after splicing the cable together.
Figure 7:
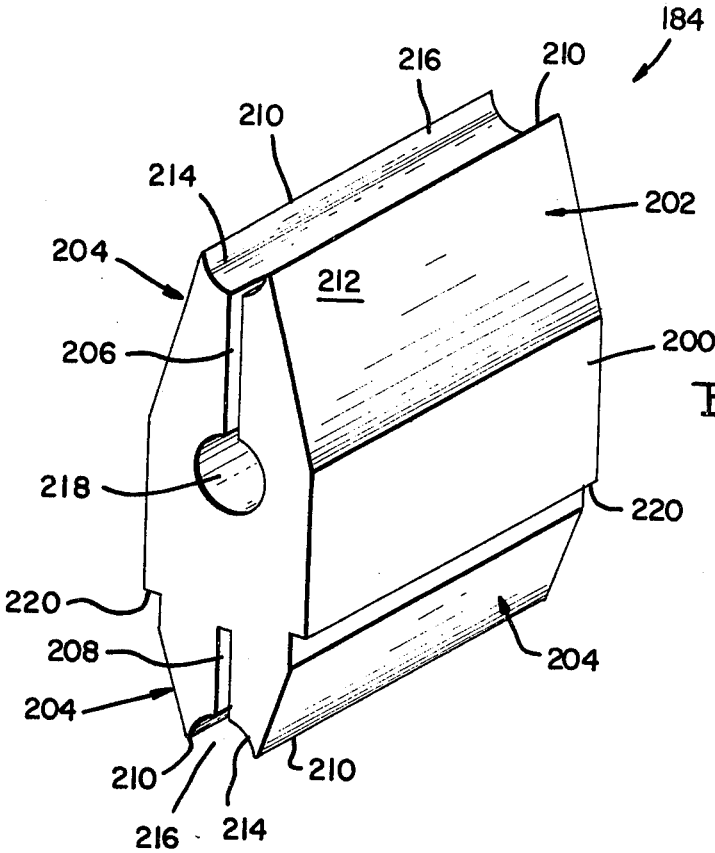

The upper half has a deep recess 48 extending from one side to the other on the top surface 50. The recess defines two sidewalls 52–54. Both sidewalls have an elongated notch 56 extending from the top edges 58 downwardly to the floor 60 of deep recess 48. Below the floor level, the notch is rounded as indicated to provide an arcuate groove 62 which extends across floor 60 from wall-to-wall. This groove is complementary to groove 32; i.e., when the two housings are joined, the two grooves form a circular passage 63 through the tap assembly (FIG. 3).

A first cavity 64 extends from the bottom of groove 62 downwardly to just below the arbitrary division between the upper and lower halves of lower housing 20. The cavity has a length equal to the width of recess 48 and a width slightly less than the diameter of groove 62.

A narrower continuation of the cavity extends downwardly almost to the bottom of lower half 46 to provide a second smaller cavity 66. A compression plate 68 of 6061-T-6 aluminum or beryllium copper having approximately the same dimensions as the second cavity is located at the bottom thereof. Immediately above the plate's upper surface, a circular opening 70 extends inwardly from wall 72 to just past the end of the length of second cavity 66 (not shown); i.e., the opening does not extend completely through the tap assembly as do grooves 32 and 62.

The change in width between the two cavities is indicated by upwardly facing shoulders 73.

Figure 2:
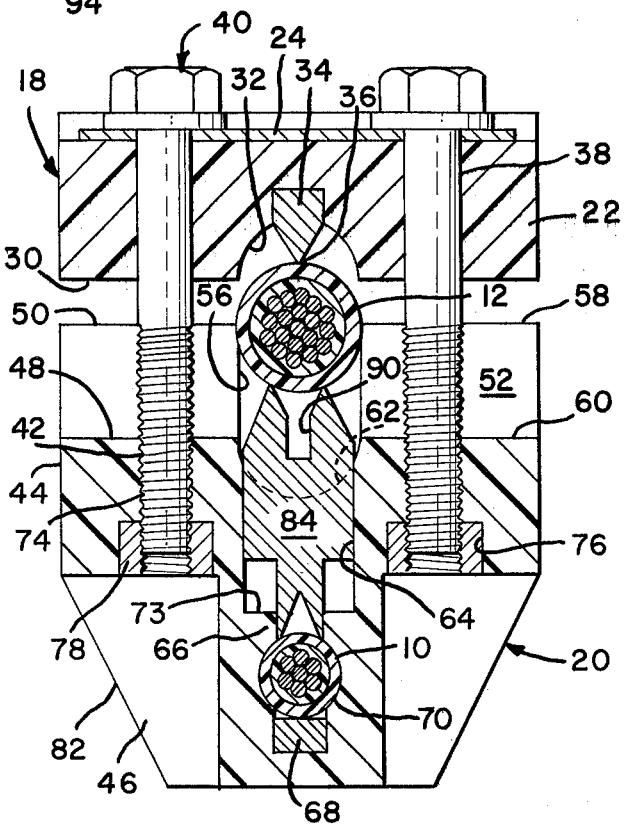
FIG. 2 is an elevational cross-sectional view taken along lines 2—2 of FIG. 1 and showing the preferred embodiment preparatory to splicing two cables together.

Two apertures 74 extend through the upper half 44 from floor 60 to a counterbore 76 at the arbitrary division between the upper and lower halves. The two counterbores 76 receive nuts 78. Access to the counterbore is provided by grooves 80 (FIG. 1) on triangular sides 82 on the lower half. As FIG. 2 shows, bolts 40 extend through apertures 74 and are threadably received by nuts 78. The two housings 18 and 20 are loosely held together in this manner.

Figure 4:
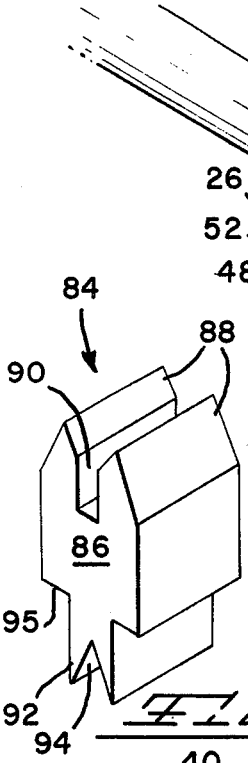
FIG. 4 is a perspective view of the commoning contact member of the present invention.

A commoning contact 84 is slidably placed in first and second cavities 64 and 66 in the lower housing 20. This contact, shown in FIG. 4, is solid and made from 6061-T-6 aluminum or beryllium copper. On top of body 86 are a pair of elongated, beveled teeth 88 separated by a slot 90. On the bottom of body 86 are two elongated, V-shaped teeth 92 separated by an inverted V-shaped slot 94. The division between the body and teeth 92 is indicated by the downwardly facing shoulders 95.

Commoning contact 84 is dimensioned so that body 86 slidingly fits in first cavity 64 with the V-shaped teeth 92 just extending into the second cavity 66 and the teeth 88 extending about half way up the sidewalls 52 and 54.

The upper and lower housings 18 and 20 are molded from 30% to 35% glass filled thermoplastic, an insulating material. For this reason tap assembly 14 can be used to electrically connect cable 10 to cable 12 without interrupting current flow through the latter. The procedure for so doing begins with completely separating upper housing 18 from the lower housing 20. The two housings are then reunited but with cable 12 trapped inbetween grooves 32 and 62. Bolts 40 are rethreaded loosely into nuts 80. Note from FIG. 2 that insulation 16 on cable 12 is still intact. Cable 10 with its insulation intact is inserted into opening 70 as far as possible. Holding cable 10 therein, bolts 40 are threaded further onto nuts 80. As this happens, tip 36 on pin 34 and teeth 88 pierce insulation 16 on cable 12 and enter into the conductor strands 96, making electrical contact. Some of the insulation and strands drown into slot 90, being helped in that aspect by tip 36. Concurrently the commoning contact 84 is being pushed down and the two teeth 92 pierce insulation 16 on cable 10 and contact conductor strands 98 therein. Compression plate 68 and the wall of circular opening 70 cooperate to prevent cable 10 from deforming. Overtravel of the commoning contact is prevented by interference between shoulder 73 in the first cavity 64 and shoulder 95 on the contact body 86. The assembly is completed upon the lower surface 30 of the upper housing 18 abutting floor 60 of the lower housing 20. Bearing plate 24 prevents excessive torque on the bolts from cracking the upper housing 18.

A strain relief device (not shown) may be incorporated onto the lower housing 20 to prevent cable 10 from being pulled out of the assembly.

FIG. 5 illustrates another embodiment of the commoning member, depicted by reference numeral 184. From the body section 200 two pair of parallel cantilever arms 202 and 204 extending from the top and bottom sides respectively. A slot 206 defines the upper or first pair of arms 202 and slot 208 defines the lower or second pair of arms 204. Each arm terminates in a sharp tip 210 running the length of the member. The tips are defined by the beveled outside surfaces 212 and curved inner surfaces 214. The two curved inner surfaces of adjacent arms combine to provide a channel 216. Slots 206 and 208 bisect the channels.

With respect to sot 206, it terminates in an enlarged circular bore 218 extending through the member. The slots 206 and 208 and bore 218 in conjunction with slot 206 provide spring characteristics to the cantilever arms.

A downwardly facing shoulder 220 is provided on either side of the body section 200 near the second or lower pair of cantilever arms 204.

In use the commoning member 184 works differently then member 84. Sharp tips 210 cut through insulation on cables 10 and 12 but do not pierce the underlying conductor strands 96. Rather, the tips slide inside the insulation and the conductor strands are pushed into channels 216 underformed. As the strands are being pushed in, the cantilever arms 202 and 204 are forced outwardly. Thereafter, the conductor strands are continuously under compressive pressure so that any dimensional changes induced in the strands by temperature or other forces are immediately counteracted.

Other modifications which will occur to those familiar with these devices include various shapes of teeth and tips on commoning contact 84. For example, single sharp tips could be employed in lieu thereof. However, by using the double configuration shown, greater area contact with the conductor strands is realized.

As will be appreciated by those skilled in the art, the cavities and grooves can be filled with a sealant material (not shown) so as to waterproof the electrical connection.

The foregoing detailed description has been given for clearness of understanding only, and no unnecessary limitations should be understood therefrom, as some modifications will be obvious to those skilled in the art.

What is claimed is:

1. An insulation piercing tap assembly for electrically connecting one cable to another, which comprises:

a. an insulative upper housing having a groove extending across the width of its bottom surface;

b. an insulative lower housing adapted to be secured to the upper housing and having a groove extending across the width of its upper surface so that it and the upper housing groove form a cable receiving passage when the two housings are secured together, said lower housing further having cable positioning means for positioning a cable above and in alignment with the groove, and further having an interior cavity extending downwardly from intersection with the groove toward the base of the housing, and an opening on one side of the housing entering into the cavity, said opening adapted to receive an end of a cable;

c. fastening means for securing the upper housing to the lower housing; and d. a conductive commoning member having a body section with a first and second pair of parallel cantilever arms extending from the top and bottom sides respectively with a slot being defined by said parallel arms, said arms terminating at their free ends in elongated sharp tips provided by beveled outside surfaces and curved inner surfaces with the combined curved inner surfaces of adjacent tips providing a channel extending the length of the member, said commoning member being slidably positioned in the cavity with the tips of the first pair of cantilever arms extending above the groove in the lower housing and the tips of the second pair of cantilever arms extending above the opening so that, with a first cable in the positioning means above the groove of the lower housing and a second cable in the opening, as the upper housing is secured to the lower housing, the first cable is driven onto the first pair of cantilever arms whereby the sharp tips thereon cut inside the insulation thereon and the underlying conductive strands are pushed into the channel and as the commoning member slides downwardly in the cavity, the sharp tips on the second pair of cantilever arms cut inside the insulation on the second cable and the underlying conductive strands are pushed into the channel, said both pair of cantilever arms then being in compression whereby dimensional changes occurring in the conductive strands are counteracted.

2. The assembly of claim 1 further including an enlarged bore intersecting the slot extending between the first pair of cantilever arms.

* * * * *